US005389000A

United States Patent [19]

DiViesti et al.

[11] Patent Number: 5,389,000

[45] Date of Patent: Feb. 14, 1995

[54] EDGE CARD CONNECTOR WITH IMPROVED LATCH/EJECT MECHANISM

[75] Inventors: Anthony M. DiViesti, Arlington Heights; Kent E. Regnier, Lombard, both of Ill.

[73] Assignee: Molex Incorporated, Lisle, Ill.

[21] Appl. No.: 154,249

[22] Filed: Nov. 18, 1993

[51] Int. Cl.[6] ..... H01R 13/62

[52] U.S. Cl. ..... 439/157; 439/160

[58] Field of Search ..... 429/152, 153, 157, 159, 429/160

[56] References Cited

U.S. PATENT DOCUMENTS

| | | | |
|---|---|---|---|
| 4,178,051 | 12/1979 | Kocher et al. | 439/157 |
| 4,313,150 | 1/1982 | Chu | 439/157 |
| 4,531,795 | 7/1985 | Sinclair | 339/45 M |
| 4,898,540 | 2/1960 | Saito | 439/153 |
| 4,973,255 | 11/1990 | Ruddy | 439/157 |
| 4,975,073 | 12/1990 | Weisman | 439/157 |
| 4,990,097 | 2/1991 | Billman et al. | 439/160 |
| 5,070,529 | 12/1991 | Beaufort et al. | 361/415 |
| 5,074,800 | 12/1991 | Sasao et al. | 439/157 |
| 5,106,315 | 4/1992 | Billman et al. | 439/160 |
| 5,108,298 | 4/1992 | Simmel | 439/157 |
| 5,162,002 | 11/1992 | Regnier | 439/637 |
| 5,167,517 | 12/1992 | Long | 439/160 |
| 5,211,568 | 5/1993 | Yamada et al. | 439/157 |

*Primary Examiner*—P. Austin Bradley
*Assistant Examiner*—Jeffrey T. Kwapp
*Attorney, Agent, or Firm*—Charles S. Cohen

[57] ABSTRACT

A connector for an edge card which includes a plurality of contact terminals spaced apart in an elongated connector housing has at least one latch/eject mechanism rotatably disposed at an end of the connector housing. The latch/eject member operates between a first operative position wherein it latches the edge card in place within the connector housing and a second operative position wherein it at least partially ejects the edge card out of the connector housing. The latch/eject member is limited in its rotation during ejection of the edge card by one or more interference surfaces formed in the latch/eject member which engage a portion of the connector housing during ejection.

23 Claims, 5 Drawing Sheets

104
101
100
110
112
101'
108
106
114
102
106'
209
202
216
204
214
224
212
218
206
217
202
210'
208
209
210
228
220
L
33
19
42'
16'
14
42
16
222
12
21
20'
10
36
22'
18
32
20
34'
40
22
38
34
222

EDGE CARD CONNECTOR WITH IMPROVED LATCH/EJECT MECHANISM

BACKGROUND OF THE INVENTION

The present invention relates generally to edge card connectors, and more particularly to an edge card connector having an improved latch/eject mechanism which is limited in the extent of its rotation during ejection of the edge card.

Circuit, or edge card, connectors have been developed for computers to provide for a connection between a main computer printed circuit board, commonly referred to in the art as a "mother board" board and secondary electronic circuits contained on smaller printed commonly referred to as "daughter" boards. These secondary circuits may be added to computers or similar electronic devices after the initial manufacture thereof to improve the performance thereof. They may be added by either a professional computer technician or a relatively unskilled computer user.

Space on the mother board on computers, as in most electronic devices, is at a premium. Consumers prefer more compact styles of electronic devise and hence, the closer that assembly components, such as daughter boards, may be spaced together on the mother board, the more compact the overall device may become.

There are a number of different known designs for connectors which are intended for permanent installation on the mother board. The connectors receive a daughter board and provide a connection between the circuitry on both of the mother board and the daughter boards. Daughter boards are often descriptively referred to in the art as "edge cards" because, one edge of the card contains a plurality of contacts which extend laterally along that edge. The edge containing these contacts is inserted into a slot of a connector. The connector slot includes a plurality contacts arranged in opposition to the edge card contacts portions. The connector contacts often extend downwardly from the connector slot through the connector body and typically terminate in tail portions which are aligned with a series of openings or penetrations on the mother board. The tails project into these openings and are soldered thereto to form an electrically conductive connection between the mother board and the edge card connector. It is also known to mount the tails to the surface of the board.

Edge card connectors are well known in the art. Some of these connectors include mechanisms which latch, or secure, the edge card in place within the connector after insertion thereof, others include mechanisms which permit the user to eject the edge card from the connector slot after insertion and still others include mechanisms which include mechanisms which perform both of the latch and eject functions. For example, U.S. Pat. No. 4,990,097, issued Feb. 5, 1991, describes an edge card connector having a card eject mechanism in which a vertically moveable member is positioned at the end of the card slot to enable a user to remove the edge card from the connector slot. However, in the act of removing an edge card from this style of connector, the user may apply too strong of a vertical uplift force on the end of the member which may be transferred to the connector and ultimately to the soldered joints near the eject mechanism. Additionally, the vertical member only reciprocates vertically and hence denies the use of a mechanical advantage obtained by using lever to eject the edge card.

U.S. Pat. No. 5,211,568, issued May 18, 1993 to the assignee of the present application, describes an eject latch/eject mechanism which is rotatably mounted to one end of the connector. The latch/eject member rotates inwardly when an edge card is inserted into the connector card slot. To partially eject one end of the edge card from the connector card slot, force is applied to the end of the latch/eject member to rotate it outwardly.

U.S. Pat. No. 5,108,298, issued Apr. 28, 1992, also to the assignee of the present invention describes a rotatable latch-eject lever which is press-fit into the connector housing. The lever is intricately formed and includes a structure that interacts with an end portion of the housing to limit rotation of the latch. Such latch may be operated by the user in a manner so as to remove it from its press-fit within the connector housing.

Accordingly, a need for an edge card connector having a latch-eject mechanism exists wherein the amount of rotation required for ejection of the edge card is limited, thereby permitting components to be placed closer to the ends of the connector.

SUMMARY OF THE INVENTION

The present invention is therefore directed to an edge card connector which offers significant advantages over the connectors described above, which is reliable and in which the amount of rotation of the latch/eject mechanism is limited.

In one principal aspect, the present invention accomplishes these advantages by providing an edge card connector having a connector body with at least one latch-eject mechanisms operatively connected to an end thereof, wherein the latch-eject mechanism rotates between first and second operative positions, whereby in the first operative position, the edge card is latched into place in the connector card slot and the latch/eject mechanism stands upright within the connector and whereby in the second operative position, the edge card is at least partially ejected from the connector card slot and the latch/eject mechanism is limited in its amount of angular rotation with respect to the connector. The latch/eject mechanism includes an engagement surface which engages one or more walls of the connector housing to effectively limit the extent of rotation which the latch/eject mechanism undergoes when it is moved to its second operative position.

In another principal aspect of the present invention, the connector includes a latch-eject mechanism having a body portion with an engagement surface angularly offset from the connector walls, the engagement surface positively engaging a wall of the connector when the latch/eject mechanism is moved to its second operative position to thereby limit the rotation of the latch/eject mechanism relative to the connector during ejection of the edge card. The engagement surface may be defined in the latch-eject member by a recess formed therein.

In yet another principal aspect of the present invention, the connector includes two latch/eject members rotatably connected to opposite ends of the connector, each of the latch/eject members including two distinct engagement portions which engage the walls of the connector during ejection of the edge card to limit the rotation of the latch/eject members.

In still yet another principal aspect of the present invention, the connector includes a latch/eject member having the engagement surface described above angularly disposed from a connector sidewall when the latch/eject member is in its first operative position, and when the latch/eject member is in its second operative position, the engagement surface is generally parallel to the connector wall which it engages.

And in yet another principal aspect of the present invention, each latch-eject member is rotatably supported in the connector end portion by a roll pin which extends transversely through the connector and latch/eject mechanism, the connector including a recess located at the end of the connector and containing a central upstanding member which cooperates with two recesses to define a lower roll pin support structure. These structures do not require the use of side inserts during forming of the connector, thereby enabling the connector body to be formed during injection molding without side pulls occurring in the molding process.

BRIEF DESCRIPTION OF THE DRAWINGS

In the course of this detailed description, reference will be made to the attached drawings in which.

DETAILED DESCRIPTION OF THE INVENTION

Figure 1:
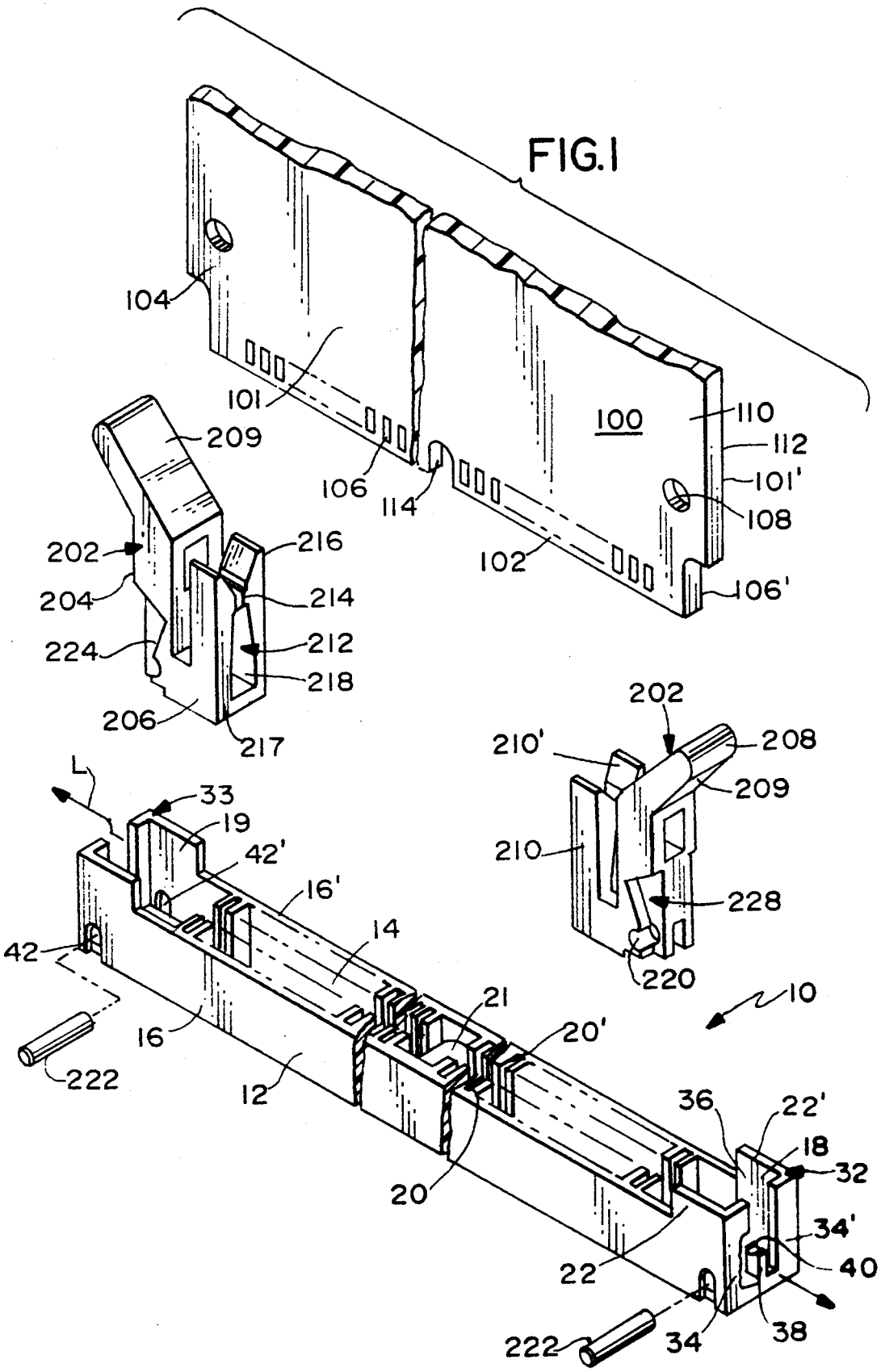
FIG. 1 is an exploded perspective view of an edge card connector constructed in accordance with the principles of the present invention with a portion of an endwall fragmented.
Figure 2:
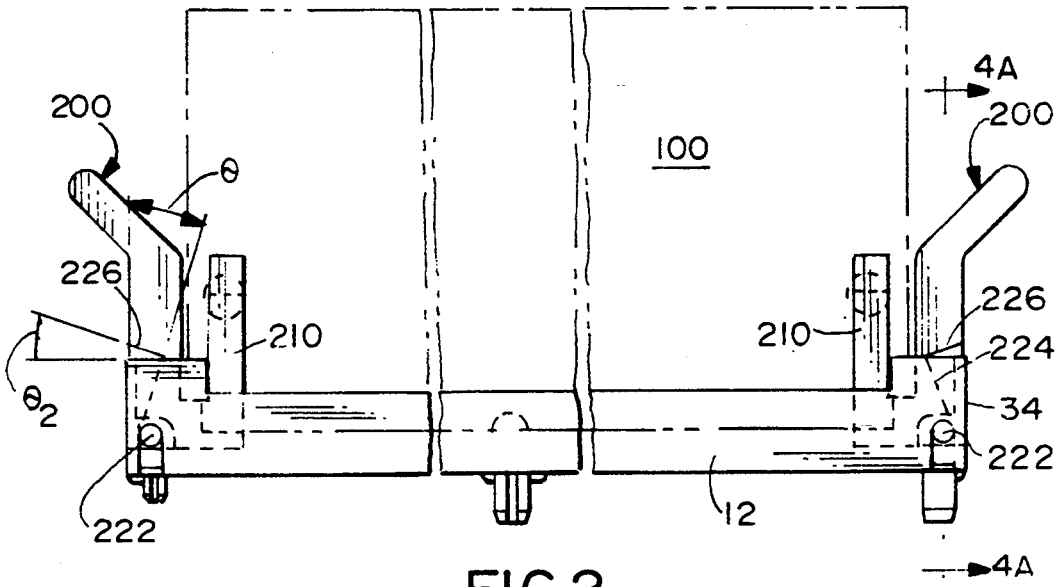
FIG. 2 is an elevational view of the edge card connector of FIG. 1 showing an edge card connector in phantom inserted into the card slot.

FIG. 1 illustrates an edge card connector, generally indicated at 10, constructed in accordance with the principles of the present invention. The connector 10 includes an insulative housing 12 having a card slot 14 extending along a longitudinal axis, "L", of the housing 12. The card slot 14 is generally defined within the housing 12 between a pair of opposed sidewalls 16, 16' which are spaced apart and are generally parallel to each other. Throughout this detailed description, a reference numeral having a prime, ', will refer to an element located on one side of the connector housing longitudinal axis L which has a corresponding element located on the opposite side of the axis.

A plurality of contact receiving cavities 20, 20' are oriented in the connector housing 12, generally transversely to the card slot 14 in a spaced-apart relationship between opposing ends, 18, 19 of the connector 10. These cavities 20, 20' receive suitable electrical contacts (not shown) which are not part of the present invention and which partially protrude into the slot 14. The contacts terminate in tail portions which extend through the bottom of the connector housing 12 where they are received in suitably shaped openings located on the mother board.

An edge card 100 is received, along a marginal edge 102 thereof, within the card slot 14 of the connector 10. The edge card 100 may be conventional in nature, having a substrate 104 and a plurality of electrical contact pads 106, 106' located along edge 102 which are connected to electrical traces (not shown) on or in the card 100. In the art, an edge card 100 accommodated by a connector 10 of the present invention may be either a "single readout" card wherein the contact pads 106, 106' on opposite sides of the card 100 are redundant (that is, each contact pad 106 on one side 101 of the card 100 is interconnected to a contact pad 106' on the other side 101' of the card) or a "dual readout" card wherein the contact pads 106, 106' on opposing sides 101, 101' of the card are not electrically interconnected together, but rather each are termination points for separate card circuits.

The card 100 may include one or more openings 108 located in an end portion 110 of the card 100 and spaced from the end 112 of the card which are designed to secure or receive one or more engagement members of the connector 10 when the edge card 100 is inserted into place within the card slot 14. The edge card 100 may also include a slot, or notch, 114 along edge 102 which interacts with a like-configured projection in card slot 14 to center the card longitudinally within same so that the contact pads 106, 106' of the card 100 are aligned with their respective contact terminals.

Figure 4A:
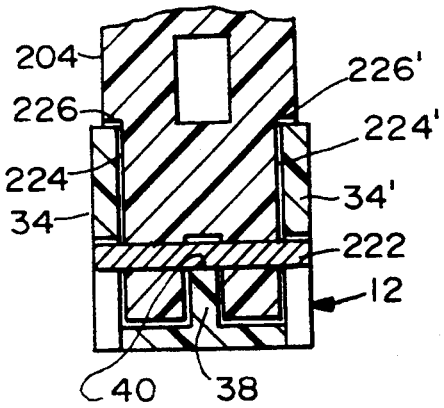
FIG. 4A is a sectional view of FIG. 4 taken along lines 4A—4A thereof.
Figure 4:
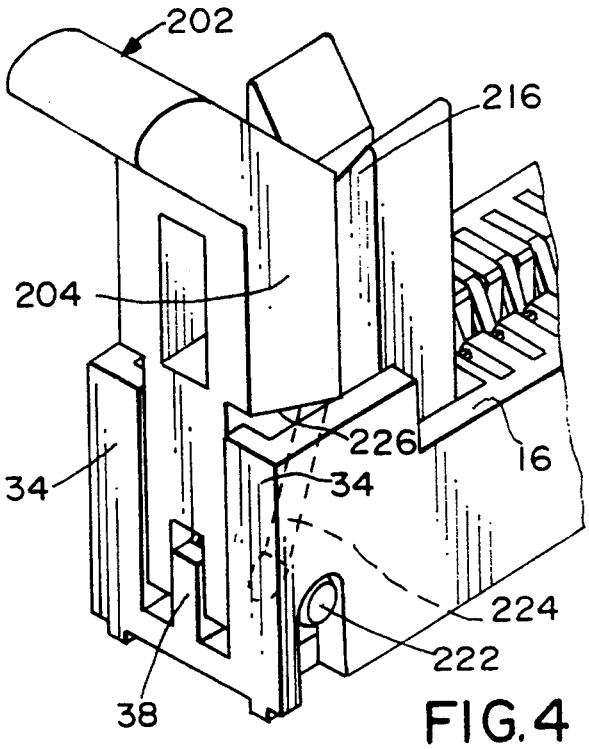
FIG. 4 is a perspective view of an end portion of the edge card connector of FIG. 1.

As best shown in FIGS. 1 and 4, each connector housing sidewall 16, 16' includes a pair of sidewall extensions 22, 22' which extend upwardly a short distance from the sidewalls 16, 16'. These extensions may be the same thickness as the housing sidewalls 16, 16' or they may be of a lesser thickness. The opposing ends 18, 19 of the connector 10 are generally defined by endwall areas 32, 33. Each endwall area 32, 33 has opposing aligned endwalls 34, 34' which are separated by a cavity 36 which partially receives latch/eject member 202. Centrally disposed in each cavity 36, is an upstanding leg member 38 with an arcuate cradle, or seat, 40 which receives a roll pin 222 so that the latch/eject member 202 is rotatably mounted to the connector 10 as described in more detail below. By utilizing roll pin 222, the latch/eject member 202 will not be pulled out of the connector housing 12 when operated as some press-fit type members are noted to do.

An arcuate arch-shaped recess 42, 42' is located in each connector sidewall 16, 16' at the ends 18, 19. The recesses 42, 42' are generally aligned together and are further aligned with the cradle 40. As seen best in FIGS. 1 & 4, the recesses 42, 42' extend entirely through the connector sidewalls 16, 16' such that a complete opening 44, 44' through the sidewall is defined. Together, cradle 40 and recesses 42, 42' define a circular opening 44, 44' slightly larger than roll pin 222. Accordingly, the connector housing 12 may be easily fabricated by injection molding where the connector housing 12 is formed by the use of two opposing mold halves that utilize only "straight pulls" and do not require mold inserts which extend sideways into the mold cavity defined between the halves. The elimination of these "side pull" inserts lowers the overall cost of manufacturing the connectors 10 of the present invention.

The connector 10 includes at least one edge card latch/eject mechanism 200 at the ends 18, 19 of the connector housing 12. Specifically, the latch/eject mechanism 200 includes a latch/eject member 202 molded from a suitable and durable plastic material, such as nylon. The latch/eject member 202 includes a body portion 204, a base portion 206 and an actuator portion 208. The actuator portion 208 extends upwardly and outwardly from the body portion 204 and provides a lever, 209 for a user to apply a force thereto to rotate the latch/eject member 202 and partially eject the edge card 100 from the card slot 14 as explained below.

The base portion 206 of the latch/eject member 202 extends away from the body portion 204. In the embodiment shown in FIGS. 1 and 4–6, the latch/eject member 202 has a pair of resilient arms 210 extending upwardly from the base portion in a cantilevered manner. The arms 210 are spaced apart and define a card-receiving space 212 therebetween. The arms 210 may include inner projections, such as bosses 214 which engage card openings 108 to retain the edge card 100 in place within the connector card slot 14. The arms 210 preferably possess a tapered profile (FIG. 4) wherein the thickness of the arms 210 tapers down from the arm ends 216 to the arm bases 217 where they meet the base portion 206. This taper imparts a desired degree of resiliency to the arms 210 adjacent base portion 206 while retaining the rigidity adjacent arm ends 216 necessary to securely grip the edge card 100. A slot 218 is located in the base portion 206 and extends from the body portion 204 to the card-receiving space 212 between the arms 210. This slot 218 defines a portion of the card and the arms 210 cooperate to define a card-receiving space 212 of the latch/eject member 202. The latch/eject member 202 further includes a cylindrical opening 220 which extends through the body portion 204 and, as mentioned above, receives the roll pin 222 to rotatably connect the latch/eject member 202 to the connector housing 12.

In an important aspect of the present invention, the latch/eject member 202 includes means for limiting the rotation of the latch/eject member 202 when force is applied to the actuator portion 208. This rotation limiting means includes at least one engagement surface 224 which acts as a stop. The engagement surface 224 extends angularly upwardly in the body portion 204 from the roll pin opening 220.

Figure 5:
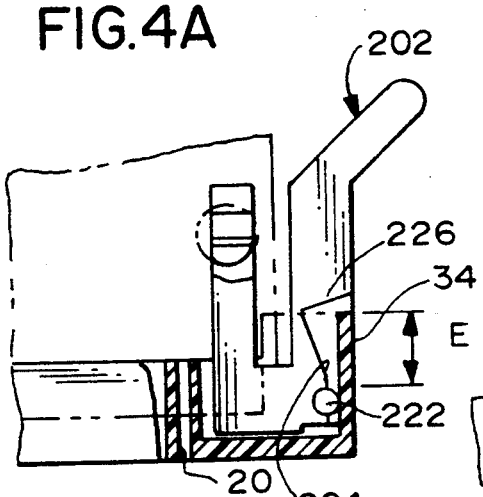
FIG. 5 is an elevational view, partially in phantom, of the edge card connector of FIG. 1 showing the latch eject member in a latch position.
Figure 6:
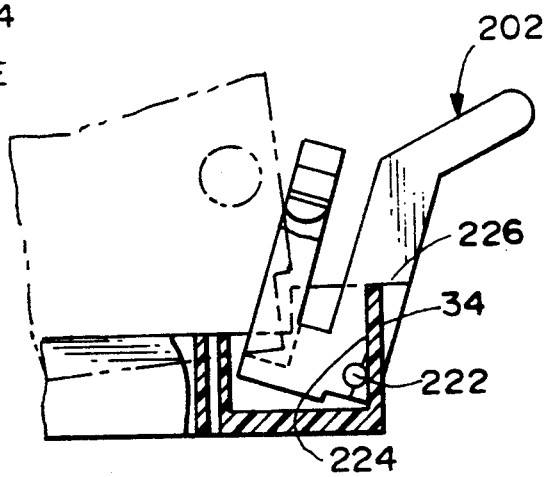
FIG. 6 is an elevational view, partially in phantom, of the edge card connector of FIG. 1 showing the latch-eject mechanism in an eject position.

The engagement surface 224 has an angular orientation relative to endwalls 34, 34' when the latch/eject member 202 is in its card-receiving position. (FIG. 5.) Upon moving the latch/eject member 202 to its second, card ejecting position, as shown in FIG. 6, a force is applied to the actuator portion 208 thereof, the engagement surface 224 occupies a generally vertical orientation where it is generally parallel to the connector endwalls 34, 34'. The engagement surface 224 may be formed on both sides of the latch/eject member body portion 204 for purposes of symmetry and further favorable distribution of forces.

Figure 3:
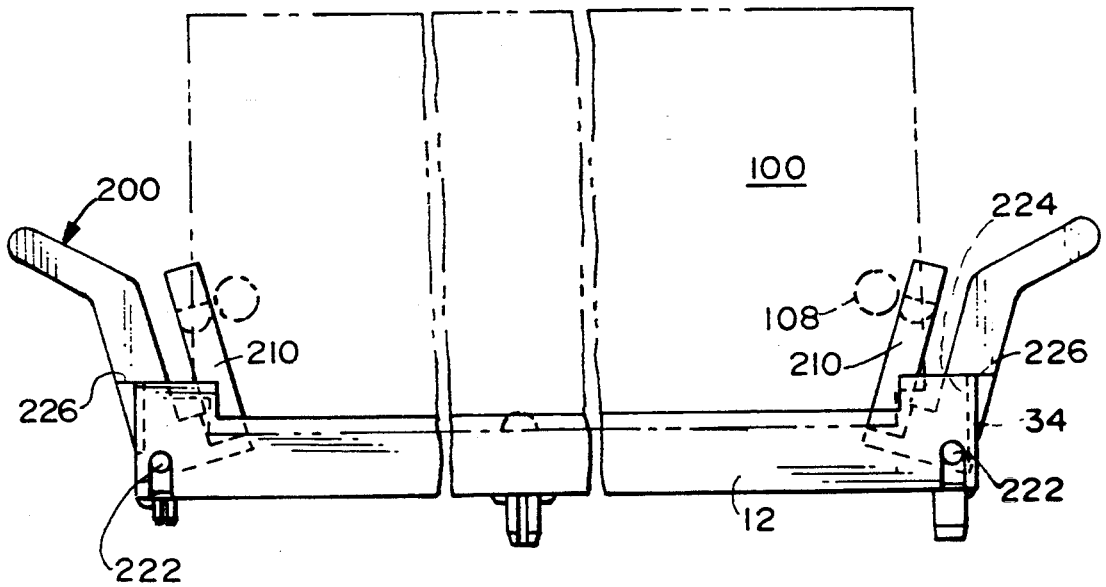
FIG. 3 is an elevational view of the edge card connector of FIG. 1 showing the edge card in phantom partially ejected from the card slot.

A second surface 226 may also be present in the latch/eject member body portion 204 offset from engagement surface 224 and which cooperates therewith to define a recess 228 in the latch/eject member 202. The second surface 226 of the recess is also angularly oriented within the latch/eject member 202 relative to a horizontal datum line, such as the connector sidewalls 16, 16' or the sidewall extensions 32, 32'. When the latch/eject member 202 is rotated to its card ejecting position shown in FIG. 6, the second surface 226 may be generally horizontal and parallel to the connector sidewall extensions 34, 34'. As best seen in FIGS. 3 and 6, each second surface 226 not only becomes generally horizontally and parallel to its respective connector sidewall extension 34 or 34', it also engages the top of its respective sidewall extension.

Figure 12A:
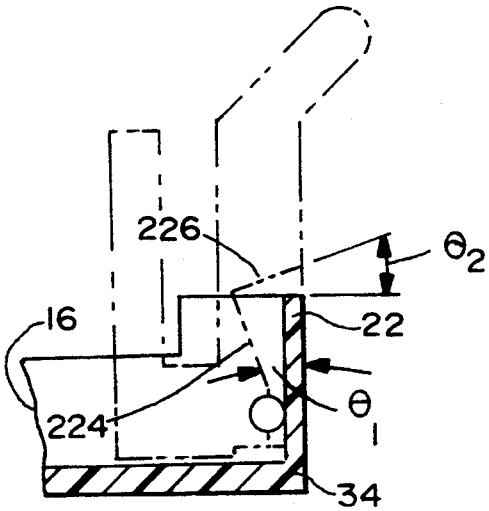
Figure 12B:
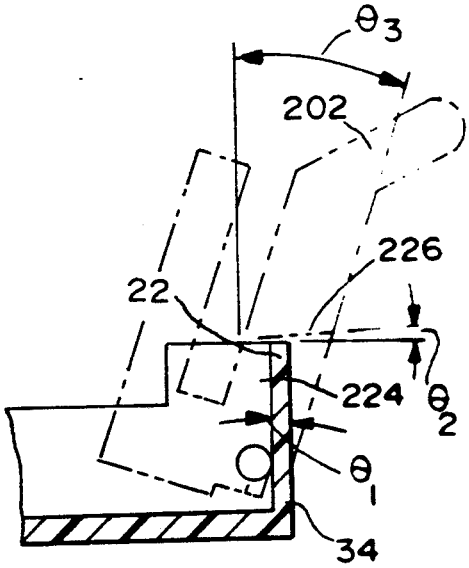

Insofar as an engagement surface 224 is present on the latch/eject member 202 within recess 228, FIG. 12, is a diagram of the relationship between the recess first and second surfaces 224, 226 and the connector sidewalls 22 and endwalls 34. The surfaces 224, 226 are preferably oriented on the latch/eject member 202 so that they are offset from their opposing connector housing engagement portions, sidewall 22 and endwall 34. In this orientation, engagement surface 224 is offset from the vertical (as represented by endwall 34) at an angle $\theta^1$, while recess second surface 226 is offset from the horizontal (as represented by sidewall 22) at an angle $\theta^2$. When the latch/eject member 202 is moved to its maximum rotation, represented by angle $\theta^3$, the angular displacement of the two surfaces 224, 226, namely, $\theta^1$ and $\theta^2$ approach 0°, that is, they are now respectively generally parallel to the vertical and horizontal surfaces of the connector housing 12. As shown in FIGS. 3 and 6, the two surfaces 224, 226 actually come in contact with the end walls 34, 34' and the angles $\theta^1$ and $\theta^2$ reach 0°.

The engagement surface 224, limits the rotation at the latch/eject member, but still reliably ejects the edge card 100. It has been found that this angular rotation of the latch/eject member 202 may be as little as 20°, which may be equivalent to the angular displacement of the engagement surface 224 from the vertical when the latch/eject member 202 is in its first, latching position.

Importantly, because the users of the connector of the present invention may be accustomed to substantially more rotation of the latch/eject member 202, they initially may seek to rotate the member 202 consistent with their prior memory of other latching connectors. In order to effectively resist the forces which such a user may apply to the latch/eject member 202, the engagement surfaces 224, 224' are oriented in the latch/eject member body portion 204 such that substantially all of the length, "H", of the surfaces 224, 224' engage the connector housing endwalls 34, 34' at the point of maximum angular rotation of the latch/eject member 202. As best seen in FIG. 6, this engagement spreads the force applied to the latch/eject member 202 by the user along a large portion of the length, "E", of the endwalls 34, 34' to reduce the stresses generated in the endwalls 34, 34' when they contact the latch/eject member 202.

Figure 11:
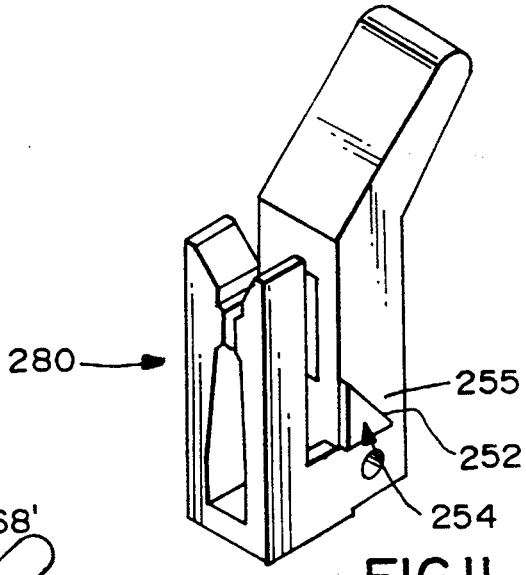
FIG. 11 is a perspective view of a fourth embodiment of a latch/eject member; and, FIGS. 12A and 12B are diagrammatic views of the interaction of the latch/eject member engagement surface with the connector housing showing a "latch" position and an "eject" position.

FIGS. 7–11 illustrate additional embodiments of the latch/eject member. FIG. 11 illustrates a latch/eject member 250 wherein the engagement surfaces 252 is formed in an outwardly extending protrusion 254 having the shape of a generally triangular abutment 255 which defines the engagement surface 252 which engages the connector housing 12. The thickness of the body portion at the level of the abutment 255 will be slightly less than the distance between the connector housing opposing sidewalls. This latch/eject member 250 operates in the same manner as the latch/eject member 202 described above.

Figure 7:
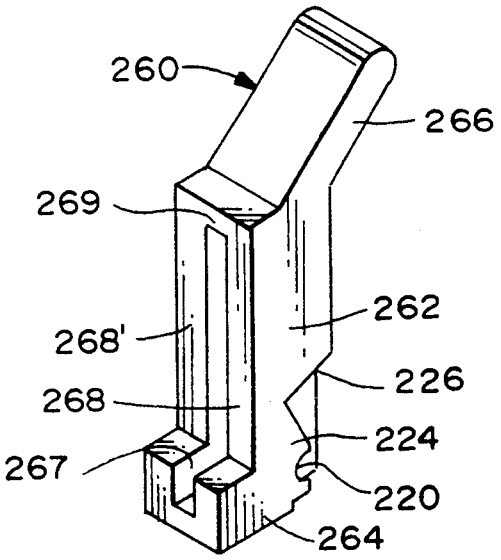
FIG. 7 is a perspective view of an alternate embodiment of a latch-eject member.
Figure 10:
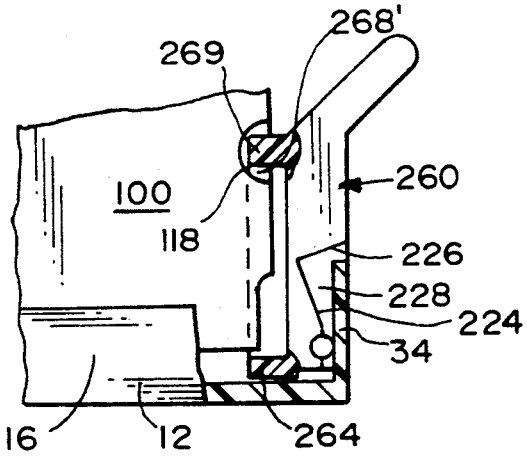
FIG. 10 is an elevational view, partially in phantom, of an end portion of an edge card connector which is a latch/eject member of FIG. 8.

FIGS. 7 & 10 illustrate another embodiment of a latch/eject member 260 intended for use in connectors of the present invention in which the latch/eject member has a body portion 262, a base portion 264 and an actuator portion 266. No resilient arms are present in this embodiment to assist in defining a card-receiving space and engage the edge card 100. Rather, a slot 267 extends through the base portion 264 and upwardly along the body portion 262 between two sidewalls 268, 268' thereof. The slot 267 terminates at a latch/eject member endwall 269, which serves as a means to engage a notch 118 in the vertical edge of the edge card 100 to retain it in place once it is fully inserted into the connector card slot 14. Apart from these particular card-receiving elements, the basic structure of the latch/eject member 260 is the same as that described above, i.e., it contains a rotation limiting means having an engagement surface 224 intersecting with a second surface 226 to define a recess 228 therein.

Figure 8:
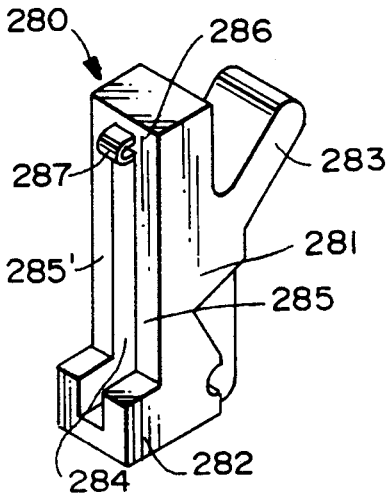
FIG. 8 is a perspective view of another alternate embodiment of a latch/eject member.
Figure 9:
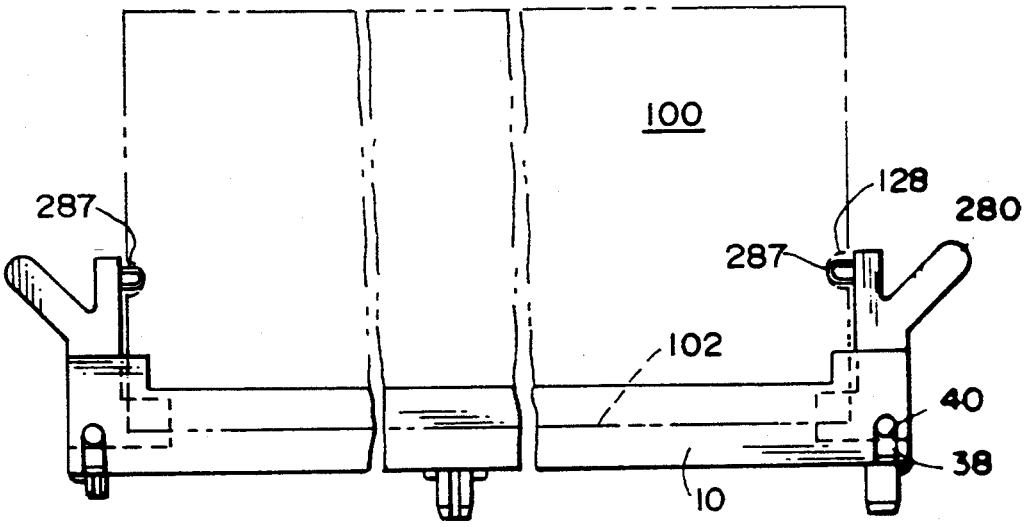
FIG. 9 is an elevational view of an edge card connector utilizing the latch/eject member of FIG. 8 showing an edge card, in phantom, inserted into the card slot.

Yet another embodiment of a latch/eject member 280 is illustrated in FIGS. 8 & 9 wherein the member 280 has a body portion 281, a base portion 282 and an actuator portion 283. Similar to member 260, latch/eject member 280 contains two opposing sidewalls 285, 285' which define a card-receiving slot 284 therebetween. The slot 284 extends down into and through the member base portion 282 and, at its uppermost extent terminates at a member endwall 286. The endwall 286 include a resilient metal clip 287, or other suitable member, which projects slightly outwardly and downwardly to engage the bottom of the card notch 128. This clip 287 serves to positively engage the card 100 in place within the card slot 14 so as to prevent micromotion between the edge card 100 and the connector terminals which may result in fretting of the contact surfaces. As an alternative, such latch/eject member 280 could be utilized with a board such that the clip 287 would engage the top surface of the board to hold it in the slot 284.

It will be seen that while certain embodiments of the present invention have been shown and described, it will be obvious to those skilled in the art that changes and modifications may be made therein without departing from the true spirit and scope of the invention.

We claim:

1. A push/pull edge card connector for providing an electrical connection between a primary circuit member and a printed circuit card, an edge of said circuit card being insertable into and removable from the connector, said connector comprising:

a connector housing having an elongated card slot disposed therein and extending between two opposing end portions of said connector, the card slot having a predetermined longitudinal axis and being adapted to receive said circuit card edge therein in an electrically operative relationship, the connector housing being defined by a pair of opposing sidewalls extending generally parallel to the axis and an endwall integral with and extending between said sidewalls, said endwall having a slot therein to define a pair of spaced apart, upstanding endwall sections, each said endwall section extending generally perpendicularly from an end portion Of one of said sidewalls to define an L-shaped structure, a plurality of contact terminals disposed in said housing, each terminal having a portion positioned in said card slot for slidingly engaging said circuit card upon insertion thereof into said card slot, a latch/eject mechanism positioned on at least one end portion of said connector housing, the latch/eject mechanism including a latch/eject member which is rotatable between a first position at which said circuit card is retained within said card slot and a second position at which at least a portion of said circuit card is ejected from said card slot and at which a portion of said latch/eject member extends through said slot in said endwall, said latch/eject mechanism including means for limiting the rotation of said latch/eject member during ejection of said circuit card from said card slot, the rotation limiting means including an engagement surface formed on said latch/eject member, the engagement surface being generally vertical and engaging one of said connector housing endwall sections when said latch/eject member is moved to said second position to thereby limit rotation of said latch/eject member, and means to rotatably retain said latch/eject member within said housing.

2. The connector of claim 1, wherein said engagement surface is defined by a projection formed on said latch/eject member.

3. The connector of claim 1, wherein said latch/eject member engagement surface is oriented on said latch/eject member at an angle of approximately 20° from vertical when said latch/eject member is in said first position.

4. The connector of claim 1, wherein said latch/eject member includes a second surface, and wherein said engagement and second surfaces define a generally triangularly shaped recess disposed in said latch/eject member.

5. The connector of claim 1, wherein said latch/eject member includes a body portion having a vertical slot defined therein, said slot receiving a portion of said circuit card when said circuit card is inserted in said connector card slot, said slot having an end portion defined by a transverse member which is adapted to engage an upwardly facing surface on said circuit card to prevent removal of said circuit card.

6. The connector of claim 1, wherein said connector includes two latch/eject members at opposite ends of said connector housing.

7. The connector of claim 1, wherein said latch/eject member includes a base portion and a body portion extending upwardly from said base portion, said base and body portions each having a common slot which receives a portion of said circuit card when said circuit card is fully inserted into said connector card slot, said latch/eject body portion further having a resilient clip member extending therefrom adapted to engage an upwardly facing surface of said circuit card in order to retain said circuit card in said housing card slot.

8. The connector of claim 1, wherein said engagement surface is defined by a recess formed in said latch/eject member and wherein substantially all of said engagement surface engages said one of said connector housing endwall sections when said latch/eject member is moved to said second position.

9. The connector of claim 8, wherein said latch/eject member recess includes a second surface offset from said engagement surface and said engagement and second surfaces are angularly offset from each other, said latch/eject member being dimensioned so that when said latch/eject member is rotated to said second position, said engagement surface is generally parallel to said one of said connector housing endwall sections and said second surface is generally parallel to said connector housing sidewall and engages an upper surface of said one of said housing endwall sections.

10. The connector of claim 1, wherein said latch/eject member further includes a pair of resilient arms for latching an opening in said circuit card in said card slot and a manually manipulatable actuator portion spaced apart from and extending away from said resilient arms.

11. The connector of claim 10, wherein said resilient arms include a pair of cantilevered members extending upwardly from a body portion of said latch/eject member, each of the resilient arms tapering in their respective thickness from top to bottom, and a boss disposed on each of said resilient arms adapted to engage said opening in said circuit card.

12. The connector of claim 1, including a generally cylindrical metal pin extending through said latch/eject member and a generally round, pin support area of said connector housing.

13. The connector of claim 12, wherein said pin support area is defined by an upstanding member between said sidewalls having an arcuate cradle facing in a first direction and an opening in each said sidewalls adjacent said endwall having an arcuate arch facing in a second direction opposite said first direction.

14. The connector of claim 12 wherein said arcuate cradle of said upstanding member faces upward and said arcuate arch of said sidewalls faces downward.

15. The connector of claim 14 wherein said latch/eject member includes a downwardly facing passage into which said upstanding member extends.

16. In a push/pull edge card connector for providing an electrical connection between a primary circuit member and a printed circuit card, an edge of said circuit card being insertable into and removable from the connector, said connector including:

an elongated connector housing having a bottom surface for mounting adjacent said primary circuit member and an elongated card slot for receiving said circuit card edge therein in an electrically operative relationship, the card slot extending between two opposing end portions of said connector and having a predetermined longitudinal axis, the connector housing being defined by a pair of opposing sidewalls extending generally parallel to the axis and an upstanding, cantilevered member positioned between said sidewalls adjacent an end portion of the connector housing, each said sidewall including an opening adjacent said end portion;

a plurality of contact terminals disposed in said housing, each terminal having a portion positioned in said card slot for slidingly engaging said circuit card upon insertion thereof into said card slot;

an eject mechanism positioned adjacent said end portion of said connector housing, the eject mechanism including an eject member which is rotatable between a first position at which said circuit card is positioned within said card slot and a second position at which at least a portion of said circuit card is ejected from said card slot;

a pin member extending through said opening in said sidewalls and an opening in said eject member to rotatably retain said eject member within said housing;

wherein the improvement comprises:

each sidewall including a slot adjacent said end portion of the housing extending from said bottom surface of the housing towards an upper portion of said housing, an upper surface of said slot being arcuate to define an outer arcuate arch for supporting said pin member on an upper first side, the arcuate arch of said sidewalls being laterally aligned relative to said longitudinal axis of the connector housing; and an upper surface of said upstanding, cantilevered member being arcuate to define a central arcuate cradle for supporting said pin member on a lower second side, opposite said first side.

17. The edge card connector of claim 16 further comprising at least one endwall extending between said sidewalls at said end portion of the housing, said endwall including a slot therein to define a pair of spaced apart, upstanding endwall sections, said eject mechanism further including means for limiting the rotation of said eject member during ejection of said circuit card from said card slot, the rotation limiting means including an engagement surface formed on said eject member for engaging a portion of said endwall sections adjacent said endwall slot when said eject member is moved to said second position to thereby limit rotation of said eject member.

18. The edge card connector of claim 16, wherein said eject member has a base portion with two card-engagement arms extending therefrom in a cantilevered manner, said engagement arms being adapted to engage an opening of said circuit card to retain said circuit card in said card slot.

19. The edge card connector of claim 16, wherein said eject member has a body portion with two upstanding walls interconnected by a cross member, said endwall being received above an upwardly facing surface of said circuit card upon insertion into said connector card slot and said eject member is in said first position to retain said circuit card in said card slot.

20. The edge card connector of claim 16, wherein said eject member has a body portion with two upstanding spaced apart wall portions and a resilient clip member extending outwardly from said wall portions, the clip member engaging an upwardly facing surface of said circuit card to secure said circuit card in said card slot.

21. A push/pull edge card connector for providing an electrical connection between a primary circuit member and a printed circuit card, an edge of said circuit card being insertable into and removable from the connector, said connector comprising:

a connector housing having an elongated card slot disposed therein and extending between two opposing end portions of said connector, the card slot having a predetermined longitudinal axis and being adapted to receive said circuit card edge therein in an electrically operative relationship, the connector housing being defined by a pair of opposing sidewalls extending generally parallel to the axis and an endwall extending between said sidewalls, said endwall having a slot therein to define a pair of spaced apart, upstanding endwall sections, each said endwall section extending generally perpendicularly from an end portion of one of said sidewalls to define an L-shaped structure, a plurality of contact terminals disposed in said housing, each terminal having a portion positioned in said card slot for slidingly engaging said circuit card upon insertion thereof into said card slot, a latch/eject mechanism positioned on at least one end portion of said connector housing, the latch/eject mechanism including a latch/eject member which is rotatable between a first position at which said circuit card is retained within said card slot and a second position at which at least a portion of said circuit card is ejected from said card slot and at which a portion of said latch/eject member extends through said slot in said endwall, said latch/eject mechanism including means for limiting the rotation of said latch/eject member during ejection of said circuit card from said card slot, the rotation limiting means including first and second surfaces formed on said latch/eject member, the first surface being positioned so that substantially the entire length thereof engages a side surface of one of said connector housing endwall sections when said latch/eject member is moved to said second position and the second surface being generally horizontal and engaging an upper surface of said connector housing endwall when said latch/eject member is moved to said second position to thereby limit rotation of said latch/eject member, and means to rotatably retain said latch/eject member within said housing.

22. The connector of claim 21, including a generally cylindrical metal pin extending through said latch/eject member and a pin support area of said connector housing.

23. The connector of claim 22, wherein said pin support area is defined by an upstanding member between said sidewalls having an arcuate cradle facing in a first direction and an opening in each said sidewalls adjacent said endwall having an arcuate arch facing in a second direction opposite said first direction.

* * * * *